US006488421B2

(12) United States Patent
Earle et al.

(10) Patent No.: US 6,488,421 B2
(45) Date of Patent: Dec. 3, 2002

(54) PROCESSING PHOTOGRAPHIC MATERIAL

(75) Inventors: Anthony Earle, Harrow Weald (GB); Nigel R. Wildman, Watford (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/032,997

(22) Filed: Oct. 25, 2001

(65) Prior Publication Data

US 2002/0081119 A1 Jun. 27, 2002

(30) Foreign Application Priority Data

Nov. 3, 2000 (GB) ..... 0026948

(51) Int. Cl.[7] ..... G03D 3/02; G03D 13/00
(52) U.S. Cl. ..... 396/565; 396/626; 137/563
(58) Field of Search ..... 396/565, 617, 396/620, 626, 636; 355/27–29; 137/563, 565.33, 565.35

(56) References Cited

U.S. PATENT DOCUMENTS

| | | | |
|---|---|---|---|
| 4,804,990 A | 2/1989 | Jessop | |
| 4,827,109 A | 5/1989 | Matsumoto et al. | |
| 4,929,974 A | 5/1990 | Sakamoto et al. | |
| 5,309,191 A | 5/1994 | Bartell et al. | |
| 5,313,243 A | 5/1994 | Rosenburgh et al. | |
| 5,353,083 A | 10/1994 | Rosenburgh et al. | |
| 5,353,086 A | 10/1994 | Piccinino, Jr. et al. | |
| 5,353,088 A | 10/1994 | Rosenburgh et al. | |
| 5,381,203 A | 1/1995 | Piccinino, Jr. et al. | |
| 5,389,994 A | 2/1995 | Rosenburgh et al. | |
| 5,400,106 A | 3/1995 | Rosenburgh et al. | |
| 5,420,658 A | 5/1995 | Manico et al. | |
| 5,567,310 A | 10/1996 | Nakashima | |
| 5,664,253 A | 9/1997 | Meyers | |
| 5,713,058 A | 1/1998 | Rider | |
| 5,761,561 A | 6/1998 | Foster et al. | |
| 6,024,503 A | 2/2000 | Nakano et al. | |
| 6,105,787 A | 8/2000 | Malkin | |
| 6,276,395 B1 * | 8/2001 | Poncelet et al. | 396/626 |

FOREIGN PATENT DOCUMENTS

| | | |
|---|---|---|
| JP | 60075316 | 4/1985 |
| JP | 61-112148 | 5/1986 |
| JP | 62-215955 | 9/1987 |
| JP | 1267649 | 10/1989 |
| JP | 2251956 | 10/1990 |
| JP | 02-253254 | 10/1990 |
| JP | 07-146538 | 6/1995 |
| JP | 8022111 | 1/1996 |
| JP | 10239815 | 9/1998 |

* cited by examiner

*Primary Examiner*—D. Rutledge
(74) *Attorney, Agent, or Firm*—Frank Pincelli

(57) ABSTRACT

A method of reducing the volume of a processing tank by only filtering processing solution when it is either drawn into the tank and circulation system or when it is returned to the supply container.

7 Claims, 2 Drawing Sheets

PROCESSING PHOTOGRAPHIC MATERIAL

FIELD OF THE INVENTION

This invention relates to an apparatus for processing photographic material. In particular the invention relates to a method of reducing the volume of low volume processors.

BACKGROUND OF THE INVENTION

The processing of photosensitive material such as photographic film involves a series of steps such as developing, bleaching, fixing, washing and drying. In this process a continuous web of film or cut sheet of film is sequentially conveyed through a series of stations or tanks, with each one containing a different processing solution appropriate to the process step at that stage.

A large photofinishing apparatus utilises rack and tank configurations that contain approximately 100 liters of each processing solution. A smaller photofinishing apparatus such as a minilab may have tanks which contain less than 10 liters of processing solution. However these tanks have generally been replaced by low volume thin tanks in which the material to be processed passes through a narrow processing channel. Such a processing apparatus is disclosed in, for example, U.S. Pat. No. 5,420,658. This document discloses a low volume photographic material processing apparatus that utilises a narrow substantially horizontal processing channel. The channel has an upturned entrance and exit to contain the processing solution within the channel. The processing apparatus will contain a smaller volume of processing solution than was previously used in regular sized processing tanks.

However it is desirable to still further reduce the volume of the entire processing unit, including the circulation system for transferring solution from a reservoir to the processing channel and back again. This reduces the energy input to heat the solution and the time required for the processing.

It is an aim of the invention to reduce the volume of a processing unit. This has been done by removing the filter from the main circulation lines.

SUMMARY OF THE INVENTION

According to the present invention there is provided an apparatus for processing photographic material comprising a processing chamber through which the material to be processed passes, said chamber having an inlet for processing solution and an outlet for processing solution, a circulation system connecting the inlet and the outlet outside of the chamber, a buffer reservoir of processing solution for supplying processing solution to the circulation system and means for circulating the processing solution through the chamber and circulation system, filter means for filtering the processing solution being located external to the circulation system such that the solution is filtered only on entry to or exit from the circulation system.

Preferably the filter is located within the reservoir.

The invention further provides a method of processing photographic material comprising the steps of providing a processing chamber and associated circulation system with a small volume of processing solution from a reservoir of processing solution, passing the photographic material through the processing chamber, circulating the processing solution through the chamber and the system, and returning the solution to the reservoir, the processing solution being filtered as it is provided to the circulation system and/or on exit therefrom.

The apparatus of the invention allows simple flush cleaning of the processing chamber. This reduces contamination of the processing chamber by previously used solutions. The solution may be cleaned before processing or after processing depending on the position of the filter within the system. If the filter is located within the solution supply cartridge particles will settle to the bottom, extending the life of the filter. Such an embodiment also reduces the maintenance required. Furthermore, the operator never has to handle a wet filter. The apparatus saves energy by reducing the heating requirement.

The invention can be applied with advantage to multistage processes such as photographic processing including developing, fixing, bleaching, washing, etc.

The invention is applicable to any process for colour film, colour paper, reversal film, reversal paper, black and white film or paper.

BRIEF DESCRIPTION OF THE DRAWINGS

The invention will now be described, by way of example, with reference to the accompanying drawings in which.

DETAILED DESCRIPTION OF THE INVENTION

Figure 1:
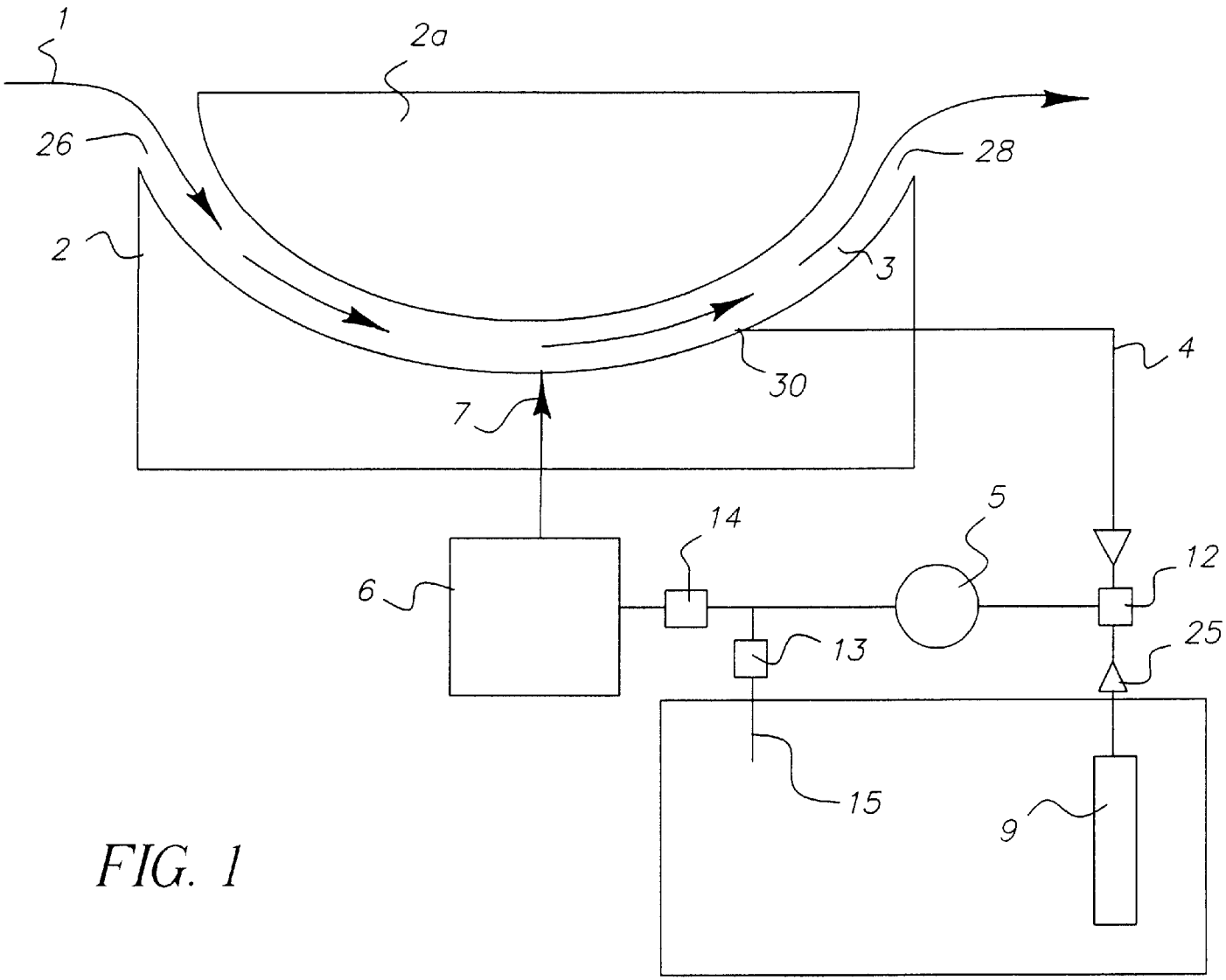
FIG. 1 shows a system according to a first embodiment of the invention.

Referring now to the drawings in detail, FIG. 1 shows schematically a first embodiment of the invention.

A processing chamber 2 has an upper section and a lower section. A narrow processing channel 3 is defined between the upper and lower sections. The chamber has an entrance 26 for the material to be processed to enter the processing channel and an exit 28 for the material to exit the channel. The material 1 is driven through the channel by any suitable means, such as roller assemblies, not shown. The chamber 2 is also provided with an inlet port 7 through which the processing solution enters the processing channel 3. An outlet port 30 for the processing solution is provided further along the channel 3 from the inlet port 7.

The processing chamber 2 may stand alone or be easily combined with other chambers to form a continuous low volume unit for processing photographic materials. Any desired number may be provided.

A circulating system 4 fluidly connects the inlet port 7 and outlet port 30 externally of the chamber 2. The circulating system 4 includes a pump 5 and a heater 6. In the embodiment illustrated the heater 6 is positioned just prior, in the direction of flow, to the inlet port 7 of the processing channel 3. A valve 14 is provided between the pump 5 and the heater 6.

A solution supply reservoir, or buffer reservoir, 10 is fluidly connected to the processing channel 3 via the circulation system 4. The total volume of the processing solution within the channel 3 and circulating system 4 is relatively small.

The reservoir may be in the form of a cartridge. The cartridge 10 is provided with two pipes 15 and 25. The cartridge also includes a filter 9. The filter removes contaminants and debris that may be contained in the processing solution. A valve 13 is provided within the pipe 15. A valve 12 is located at the pipe 25 to control flow from the reservoir 10 to the circulating system 4.

In order to provide processing solution in the processing channel 3 the pump 5 is switched on and the valve 12 is activated to allow flow of solution from the supply cartridge 10. This flow from the supply cartridge passes through the filter 9 and into the circulating system 4. Valve 13 in the pipe 15 is closed to prevent the solution returning immediately to the supply cartridge. Valve 14 is open so that the processing solution passes through the circulating system 4 and thus to inlet port 7 and through the channel 3. When the system is full valve 12 is activated to cut off flow from the cartridge 10. The solution in the system 4 is pumped around the system by pump 5 and is heated by heater 6. The solution is heated to a predetermined temperature and is then maintained at this temperature.

The volume of solution pumped around the system is small compared to the amount of solution in the full supply reservoir 10. The solution is reused as it is returned to the supply reservoir after processing takes place.

The material to be processed, for example film 1, passes through the processing channel 3 at a given speed, in the direction shown by the arrow in FIG. 1. The film 1 may be in a cut sheet or roll format. The processing solution is circulated in and through the processing channel by pump 5. The solution is pumped around the circulating system 4 in the direction of arrow 11.

After processing of the material is complete the processing solution is returned to the cartridge 10. To enable the solution to return to the cartridge valve 14 is closed and valve 13 is opened. If necessary the processing channel 3 can be flushed clean by repeating the filling and emptying of the circulating system a few times. It may be advantageous, and will also reduce energy consumption, to turn off the heater 6 during the flushing operation. The processing channel may be left empty or full as desired.

As the filter 9 is held in the supply reservoir or cartridge it is thus changed every time the chemicals are replaced. There are no extra operations required to change the filter. The filter does not have to be handled directly so there is no mess associated with the change.

Figure 2:
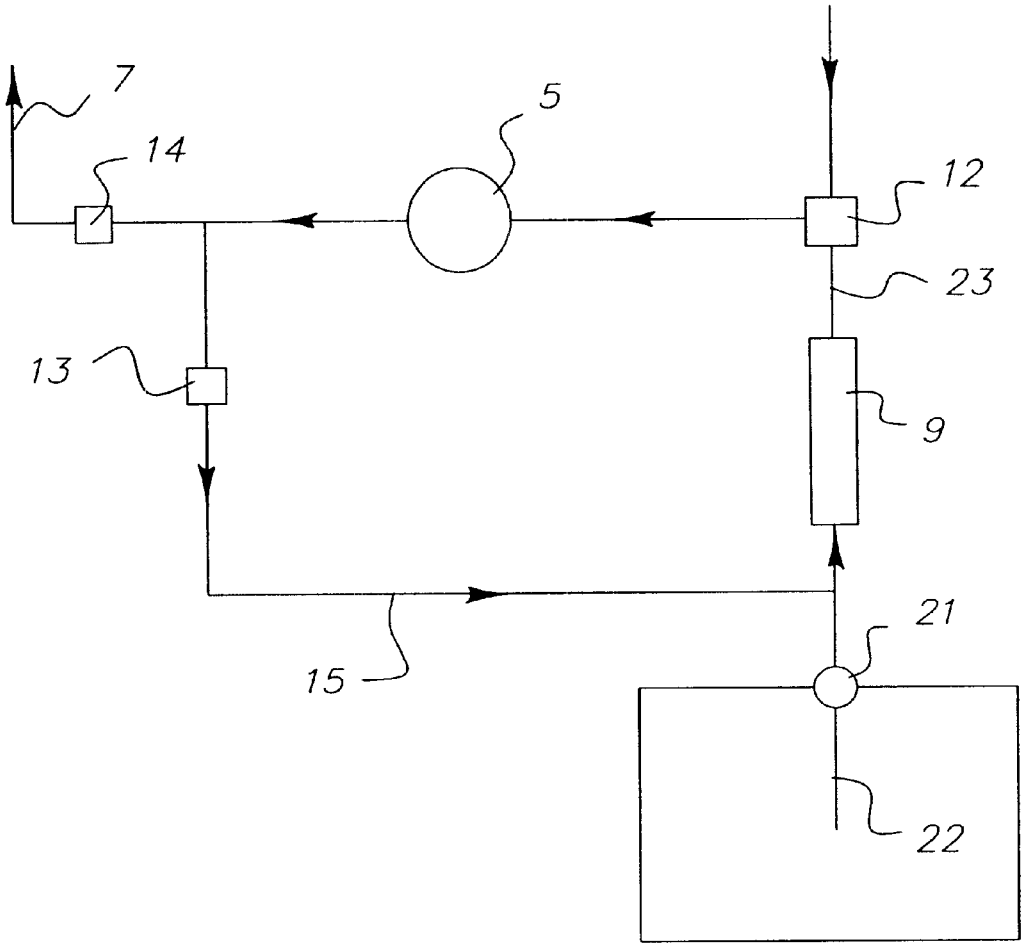
FIG. 2 shows a system according to a second embodiment of the invention.

FIG. 2 shows an alternative embodiment of the invention. The processing chamber 2 and the circulating system 4 are the same as in the embodiment shown in FIG. 1. However, in this system the filter 9 is external to the supply cartridge.

The supply cartridge 22 shown in FIG. 2 is connected to the circulating system 4 via pipe 23 and pipe 15. The cartridge 22 is a single entry supply cartridge, having only one exit/entrance point for pipe 23 and pipe 15. A valve 21 couples the cartridge to the pipes 23 and 15. The filter 9 is located in the supply pipe 23. In an alternative embodiment, not shown, the filter 9 may be located in the pipe 15. The cartridge may be of a plug-in Kodak® SM type chemical cartridge.

To fill the system circulating system 4 the pump 5 is switched on and the valve 12 is activated to allow flow of solution from the supply cartridge 22. This flow from the supply cartridge passes through the filter 9 and into the circulating system 4. Valve 13 in the pipe 15 is closed to prevent the solution returning immediately to the supply cartridge. Valve 14 is open so that the processing solution passes through the circulating system 4 and thus to inlet port 7 and through the processing channel 3. When the system is full valve 12 is activated to cut off flow from the cartridge 22. The solution in the system 4 is pumped around the system by pump 5 and is heated by heater 6. To enable the solution to return to the cartridge 22 valve 12 is closed and valve 13 is opened.

It will be understood by those skilled in the art that the valves described in the examples above are illustrative purposes only and that other suitable valves and/or taps can be used.

The system and method described above is particularly suited for batch methods of solution management or where the solution is drained and filled between processing runs.

By removing the filter from the main circulation system the volume of the processing chamber can be significantly reduced. Approximately half a liter reduction in volume is achievable with the invention.

The invention has been described in detail with reference to preferred embodiments thereof. It will be understood by those skilled in the art that variations and modifications can be effected within the scope of the invention.

PARTS LIST

1 material
2 processing chamber
3 processing channel
4 circulating system
5 pump
6 heater
7 inlet port
9 filter
10 reservoir
12 valve
13 valve
14 valve
15 pipe
21 valve
22 supply cartridge
23 pipe
25 pipe
26 entrance
28 exit
30 outlet port

What is claimed is:

1. Apparatus for processing photographic material comprising a processing chamber through which the material to be processed passes, said chamber having an inlet for processing solution and an outlet for processing solution, a circulation system connecting the inlet and the outlet outside of the chamber, a buffer reservoir of processing solution for supplying processing solution to the circulation system and means for circulating the processing solution through the chamber and circulation system, filter means for filtering the processing solution being located external to the circulation system such that the solution is filtered only on entry to or exit from the circulation system.

2. Apparatus as claimed in claim 1 wherein the filter means is located within the reservoir.

3. Apparatus as claimed in claim 1 wherein the filter means is located between the reservoir and the circulation system.

4. Apparatus as claimed in claim 1 further including a heater in the circulation system.

5. Apparatus as claimed in claim 1 wherein the means for circulating the solution comprises a pump.

6. A method of processing photographic material comprising the steps of providing a processing chamber and associated circulation system with a small volume of processing solution from a reservoir of processing solution, passing the photographic material through the processing chamber, circulating the processing solution through the chamber and the system, and returning the solution to the reservoir, the processing solution being filtered as it is provided to the circulation system and/or on exit therefrom.

7. A method as claimed in claim 6 wherein the processing solution is heated.

* * * * *